US008955931B2

(12) United States Patent
Takahashi et al.

(10) Patent No.: US 8,955,931 B2
(45) Date of Patent: Feb. 17, 2015

(54) LIQUID EJECTION HEAD AND RECORDING APPARATUS

(71) Applicant: Canon Kabushiki Kaisha, Tokyo (JP)

(72) Inventors: Sayaka Takahashi, Kawasaki (JP); Yukuo Yamaguchi, Tokyo (JP); Chiaki Muraoka, Kawaguchi (JP); Takuya Iwano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/867,612

(22) Filed: Apr. 22, 2013

(65) Prior Publication Data

US 2013/0286091 A1 Oct. 31, 2013

(30) Foreign Application Priority Data

Apr. 27, 2012 (JP) ..... 2012-103146

(51) Int. Cl.

| | |
|---|---|
| ***B41J 29/38*** | (2006.01) |
| ***B41J 2/015*** | (2006.01) |
| ***B41J 2/145*** | (2006.01) |
| ***B41J 2/14*** | (2006.01) |

(52) U.S. Cl.

CPC ..... *B41J 2/145* (2013.01); *B41J 2/1433* (2013.01); *B41J 2002/14387* (2013.01); *B41J 2002/14411* (2013.01)

USPC ..... 347/9; 347/20

(58) Field of Classification Search

CPC ..... B41J 2/14; B41J 2/135; B41J 2002/135

USPC ..... 347/9, 47, 20

See application file for complete search history.

(56) References Cited

U.S. PATENT DOCUMENTS

| | | | | |
|---|---|---|---|---|
| 6,280,020 | B1 | 8/2001 | Tachihara et al. | |
| 6,286,933 | B1 | 9/2001 | Murakami et al. | |
| 6,325,493 | B1 | 12/2001 | Yamaguchi | |
| 6,652,062 | B2 | 11/2003 | Umeyama et al. | |
| 6,824,243 | B2 | 11/2004 | Yamaguchi et al. | |
| 7,070,267 | B2 | 7/2006 | Yamaguchi et al. | |
| 7,585,616 | B2 | 9/2009 | Shaarawi et al. | |
| 2003/0048328 | A1 * | 3/2003 | Inamoto et al. | 347/44 |
| 2009/0153620 | A1 * | 6/2009 | Ikegame et al. | 347/47 |
| 2009/0191487 | A1 * | 7/2009 | Murayama et al. | 430/320 |

FOREIGN PATENT DOCUMENTS

| | | |
|---|---|---|
| JP | 11-138817 A | 5/1999 |
| JP | 2003-80717 A | 3/2003 |

* cited by examiner

*Primary Examiner* — Jason Uhlenhake

(74) *Attorney, Agent, or Firm* — Fitzpatrick, Cella, Harper & Scinto

(57) ABSTRACT

A liquid ejection head includes a substrate that carries thereon a plurality of ejection energy generating elements arranged in rows to generate energy necessary for ejecting liquid and an ejection port plate that is laid on the substrate and has a plurality of ejection ports formed therein and arranged vis-a-vis the respective ejection energy generating elements. The ejection port plate has a groove, or an oblong recess, formed on the surface thereof where the plurality of ejection ports are formed such that the groove surrounds the region where the ejection ports are formed and has a corrugated inner lateral surface and a flat outer lateral surface arranged oppositely relative to the inner lateral surface.

9 Claims, 8 Drawing Sheets

FIG. 5

| SHAPE OF EJECTION PORT PLATE | EVALUATION ITEMS | | | |
|---|---|---|---|---|
| | FOREIGN OBJECT | INK BALL | RECORDING | PEELING |
| SHAPE 1 | C | C | C | A |
| SHAPE 2 | A | A | A | A |
| SHAPE 3 | B | A | A | B |
| SHAPE 4 | B | C | A | A |
| SHAPE 5 | B | C | C | B |

LIQUID EJECTION HEAD AND RECORDING APPARATUS

BACKGROUND OF THE INVENTION

1. Field of the Invention

The present invention relates to a liquid ejection head for ejecting liquid such as ink for recording purposes and a recording apparatus having such a liquid ejection head.

2. Description of the Related Art

Known side shooter type liquid ejection heads have a recording element substrate formed by a substrate and an ejection port plate that are laid one on the other. FIG. 7 illustrates a schematic perspective view of a known liquid ejection head and FIG. 8 illustrates a schematic cross-sectional view of the liquid ejection head taken along cutting line 8-8 in FIG. 7. As seen from FIGS. 7 and 8, a plurality of ejection energy generating elements 102 are arranged on a substrate 101. More specifically, the ejection energy generating elements 102 are arranged in the longitudinal direction of supply port 103 that runs through the substrate 101. On the other hand, a plurality of ejection ports 105 are formed in an ejection port plate 104. The ejection ports 105 are arranged respectively vis-a-vis the ejection energy generating elements 102. A flow path 106 is formed between the ejection energy generating elements 102 and the ejection ports 105. Japanese Patent Application Laid-Open No. H11-138817 discloses a liquid ejection head having such a structure, of which the ejection port plate is made to have a uniform thickness. FIGS. 9A through 9D are schematic cross-sectional views of a liquid ejection head disclosed in Japanese Patent Application Laid-Open No. H11-138817, illustrating steps of manufacturing the liquid ejection head. Referring to FIGS. 9A through 9D, firstly resin layers 203*a* and 203*b* that can be dissolved are formed on a substrate 201 that bears ejection energy generating elements 202 formed therein (see FIG. 9A). Then, a resin layer 204 that is to operate as ejection port plate is laid on the substrate 201 and the resin layers 203*a* and 203*b* (see FIG. 9B). With this operation, the resin layer 204 can be laid to represent a uniform thickness because the resin layer 203*b* operates as a base. Thereafter, ejection ports 205 are formed along with a groove 206, or an oblong recess, that is formed in order to remove the resin layers 203*a* (see FIG. 9C) in a latter step. Finally, the resin layers 203*a* and 203*b* are removed and a supply port 207 is produced (FIG. 9D). At this time, a flow path 208 is produced as the resin layer 203*b* is removed by way of the ejection ports 205.

In the liquid ejection head illustrated in FIGS. 9A through 9D, the linear expansion coefficient of the substrate 201 differs from the linear expansion coefficient of the ejection port plate 204. Therefore, due to environment changes such as heat generation or conservation condition, thermal stress occurs along the interface of the substrate 201 and the resin layer (ejection port plate) 204. Then, as a result, the resin layer 204 can come off from the substrate 201. Japanese Patent Application Laid-Open No. 2003-80717 proposes a liquid ejection head that solves such a problem. FIG. 10 is a schematic perspective view of a liquid ejection head described in Japanese Patent Application Laid-Open No. 2003-80717. As illustrated in FIG. 10, the ejection port plate 302 that is laid on a substrate 301 has a groove 304, or an oblong recess, like the liquid ejection head illustrated in FIG. 9D. In the instance of the liquid ejection head illustrated in FIG. 10, the thermal stress that the ejection port plate 302 undergoes is alleviated by making the groove 304 have oppositely disposed and corrugated side wall surfaces having saw edged ridges and furrows (aperture side walls of the groove 304).

Meanwhile, foreign objects such as dust can adhere to the surface (nozzle surface) of the ejection port plate of a liquid ejection head of the type under consideration as the recording apparatus including the liquid ejection head is operated. When a recording operation is conducted in a condition where foreign objects are adhering to the ejection port plate, some properties of the surface of the ejection port plate such as wettability can be altered by the adhering foreign objects. Then, the ejection ports can be clogged by foreign objects to by turn give rise to faulty ejections. To avoid such a problem, some recording apparatus of the type under consideration are provided with a wiping member for wiping off the foreign objects adhering to the surface of the ejection port plate.

In a liquid ejection head disclosed in Japanese Patent Application Laid-Open No. 2003-80717, the side wall surfaces of groove 304 are corrugated so as to produce saw-edged ridges and furrows as illustrated in FIG. 10. Therefore, as foreign objects are caught between the oppositely disposed side wall surfaces of the groove 304, the caught foreign objects can neither be released nor removed with ease. Thus, if a wiping member is provided, the caught foreign objects may neither be released nor removed. FIG. 11A schematically illustrates a foreign object that is caught by the groove arranged in a liquid ejection head described in Japanese Patent Application Laid-Open No. 2003-80717. The ink ejected from ejection ports 303 can adhere to the foreign object 400 caught in the groove 304. If the foreign object 400 is left there for a long period of time, ink will adhere to the foreign object 400 each time the liquid ejection head is driven to eject ink. Then, the foreign object 400 eventually grows into an ink ball 401 as shown in FIG. 11B. The ink ball 401 that is produced as the foreign object 400 grows can get into one of the ejection ports 303 to give rise to faulty ejections (see FIG. 11C).

SUMMARY OF THE INVENTION

According to the present invention, there is provided a liquid ejection head including: a substrate that carries thereon a plurality of ejection energy generating elements arranged in rows to generate energy necessary for ejecting liquid; and an ejection port plate that is laid on the substrate and has a plurality of ejection ports formed therein and arranged vis-a-vis the respective ejection energy generating elements; wherein the ejection port plate has a groove, or an oblong recess, formed on the surface thereof where the plurality of ejection ports are formed such that the groove surrounds the region where the ejection ports are formed and has an inner lateral surface that is arranged adjacent to that region and has a plurality of projections and recesses arranged alternately and continuously (for corrugation) so as to produce saw edged ridges and furrows and an outer lateral surface arranged oppositely relative to the inner lateral surface and that at least the parts of the outer lateral surface running along the direction of arrangement of the ejection ports are formed flat.

Further features of the present invention will become apparent from the following description of exemplary embodiments with reference to the attached drawings.

BRIEF DESCRIPTION OF THE DRAWINGS

FIG. 5 is a table representing the results of evaluation of an embodiment of liquid ejection head according to the present invention in terms of peeling of the ejection port plate, adhesion of foreign objects and recording performance.

DESCRIPTION OF THE EMBODIMENTS

Figure 1:
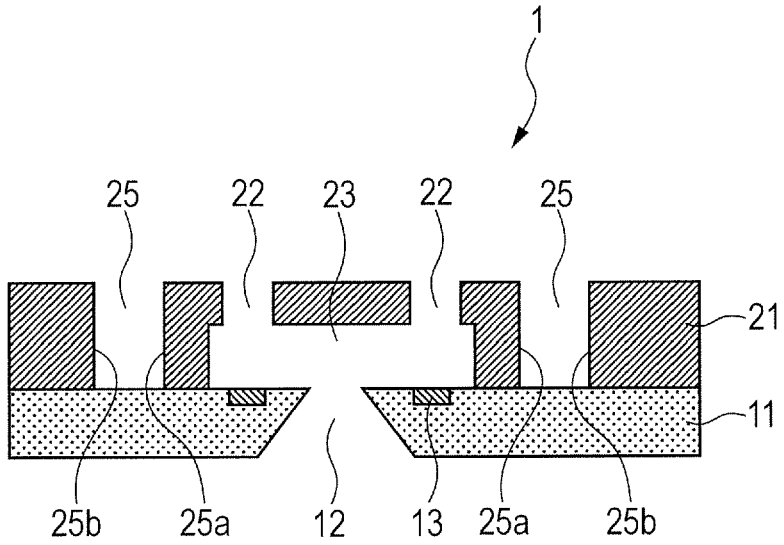
FIG. 1 is a schematic cross-sectional view of an embodiment of liquid ejection head according to the present invention.
Figure 2:
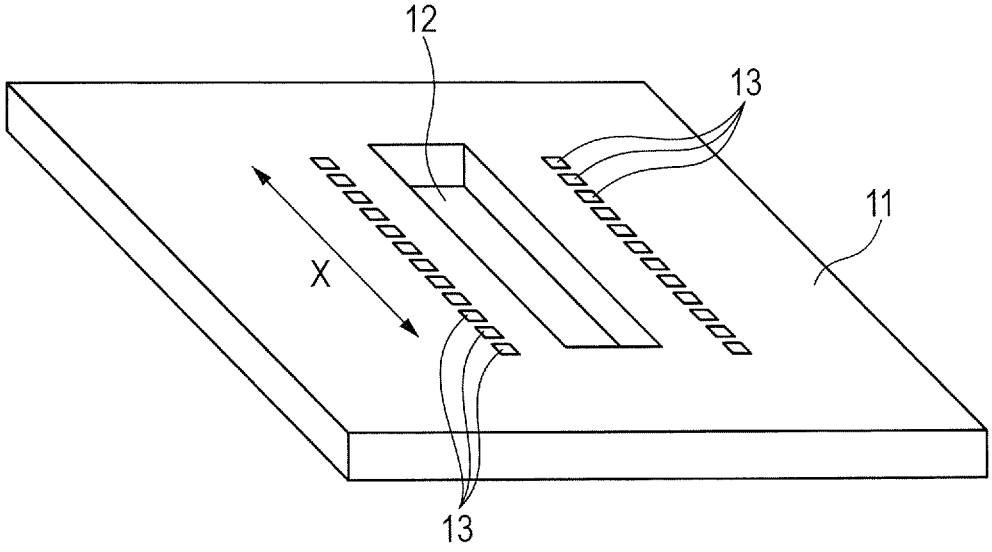
FIG. 2 is a schematic perspective view of the substrate of the liquid ejection head illustrated in FIG. 1.

FIG. 1 is a schematic cross-sectional view of an embodiment of liquid ejection head according to the present invention. As illustrated in FIG. 1, the liquid ejection head of this embodiment has a recording element substrate 1 that includes a substrate 11 and an ejection port plate 21 laid on the substrate 11. Firstly, the substrate 11 will be described. FIG. 2 is a schematic perspective view of the substrate 11 illustrated in FIG. 1. The substrate 11 that is a rectangular substrate is manufactured by means of a semiconductor manufacturing technique for manufacturing semiconductor substrates such as silicon semiconductor substrates. A supply port 12 is formed at a center part of the substrate 11 so as to run through the substrate 11 (see FIG. 1). A plurality of ejection energy generating elements 13 for generating energy necessary for ejecting liquid (which is ink in the instance of this embodiment) are arranged along the longitudinal direction X of the supply port 12 (see FIG. 2). The ejection energy generating elements 13 are designed to heat the ink supplied from the supply port 12 in order to make the ink bubble.

Figure 3:
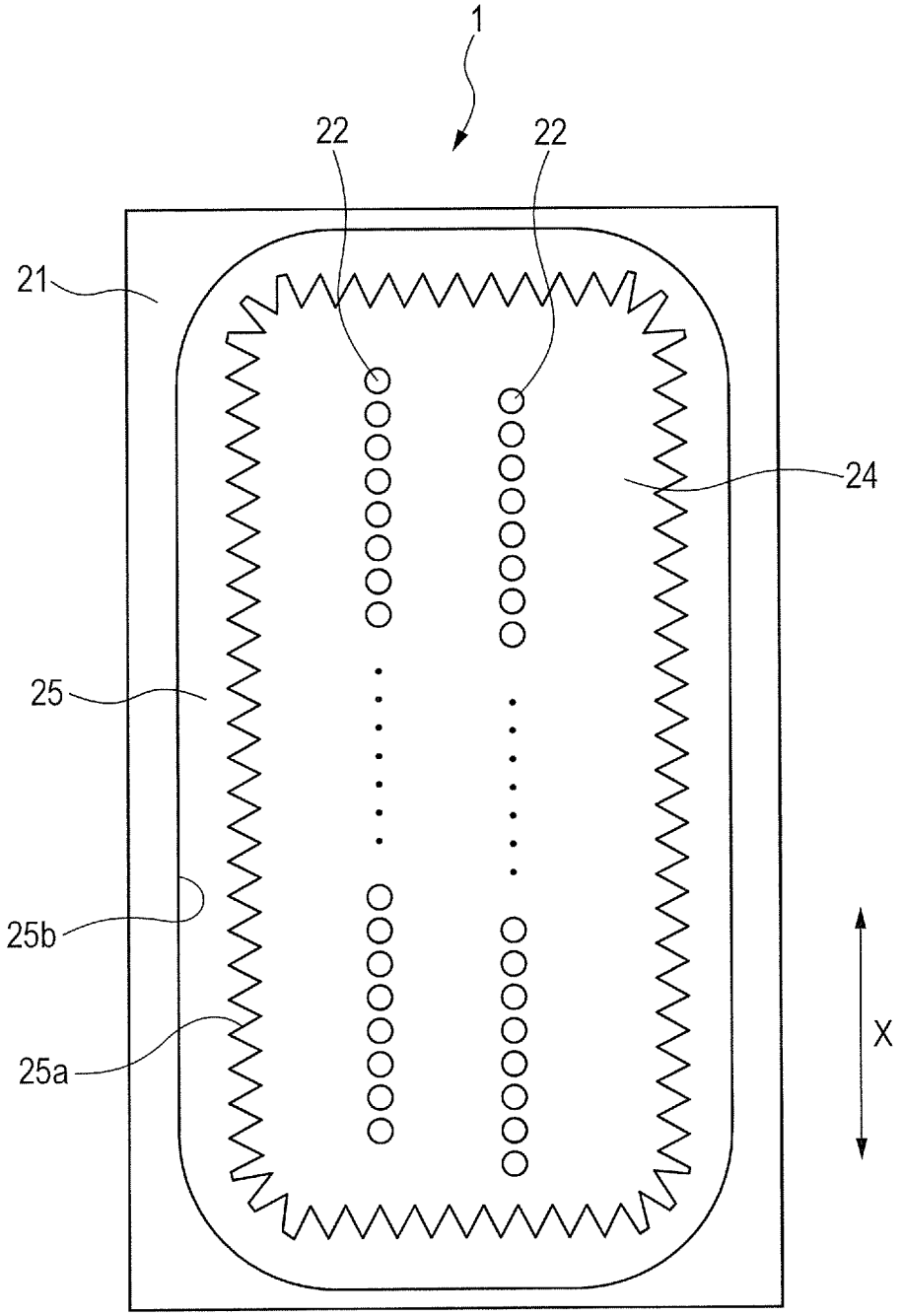
FIG. 3 is a schematic plan view of the ejection port plate of the liquid ejection head illustrated in FIG. 1.

Now, the ejection port plate 21 will be described below by referring to FIGS. 1 and 3. FIG. 3 is a schematic plan view of the ejection port plate 21 illustrated in FIG. 1. The ejection port plate 21 is preferably made of an ink-resistant resin material, more preferably of a negative type photo-setting epoxy resin, because the ejection port plate 21 is brought into contact with ink. A plurality of ejection ports 22 are formed in the ejection port plate 21 at positions located vis-a-vis the respective ejection energy generating elements 13. Thus, the ejection ports 22 are arranged in the longitudinal direction X just like the ejection energy generating elements 13. A flow path 23 is formed between the ejection ports 22 and the ejection energy generating elements 13. The ink that is heated by each of the ejection energy generating elements 13 to bubble is then ejected from the corresponding ejection port 22 by way of the flow path 23.

The region (nozzle surface 24) where the ejection ports 22 are formed is surrounded by a groove (hole section) 25, or an oblong recess. As illustrated in FIG. 3, the groove 25 has an inner lateral surface 25*a* that is located adjacent to the nozzle surface 24 and an outer lateral surface 25*b* disposed vis-a-vis the inner lateral surface 25*a*. A plurality of projections and a plurality of recesses are formed alternately and continuously on the inner lateral surface 25*a* to produce a corrugated surface having saw edged ridges and furrows. On the other hand, the outer lateral surface 25*b* is formed as a flat surface. The groove 25 (hole section) is formed as a through hole that runs through the ejection port plate 21.

Figure 4:
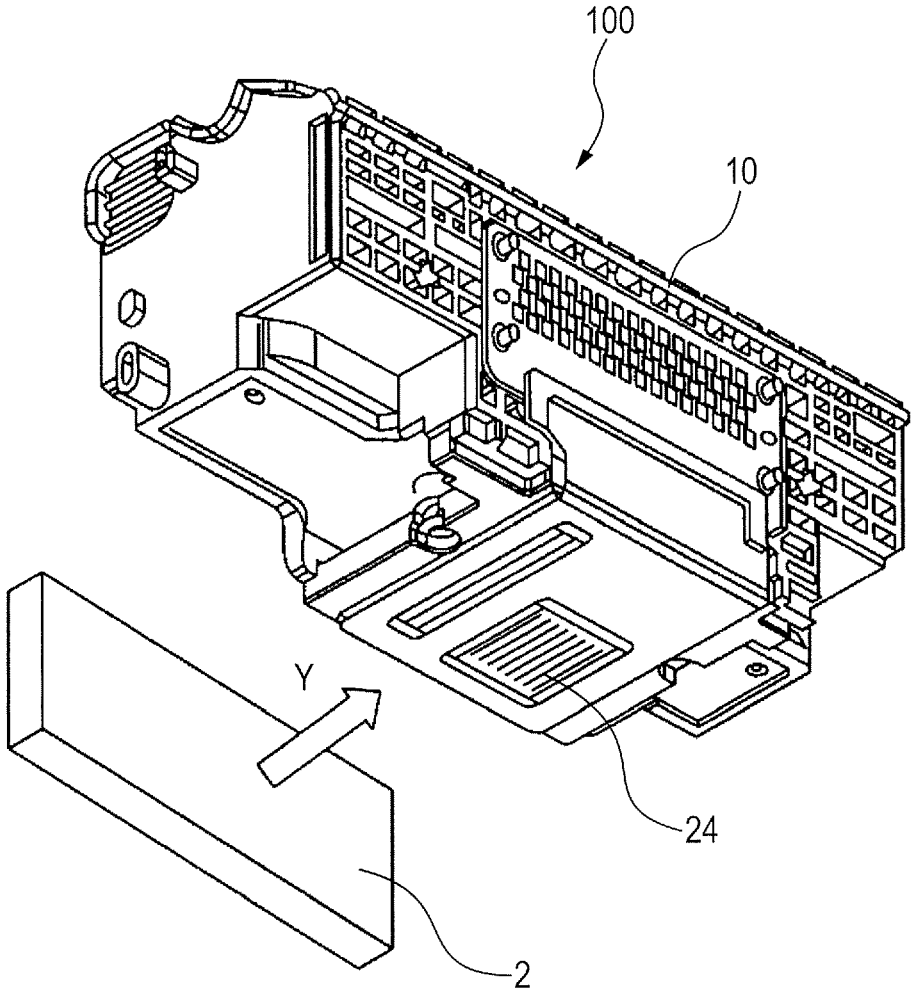
FIG. 4 is a schematic perspective view of an embodiment of recording apparatus according to the present invention, illustrating the configuration of a principal part thereof.
Figure 9A:
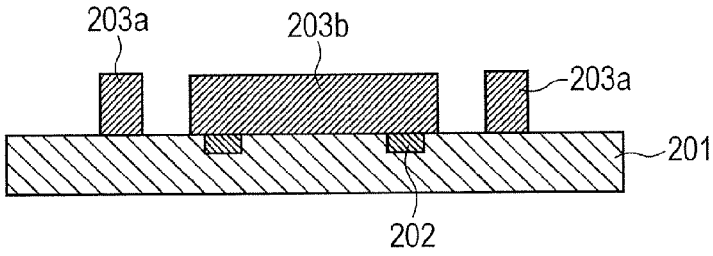
FIGS. 9A, 9B, 9C and 9D are schematic cross-sectional views of a known liquid ejection head, illustrating manufacturing steps thereof.
Figure 9B:
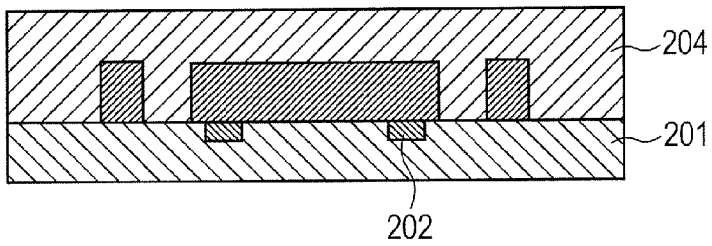
Figure 9C:
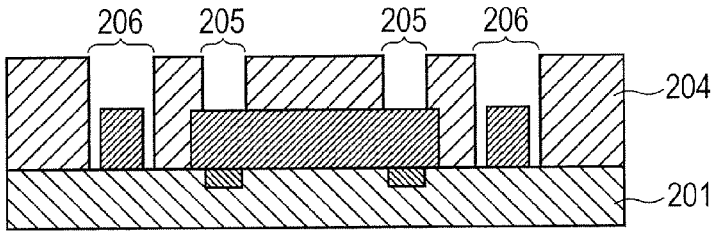
Figure 9D:
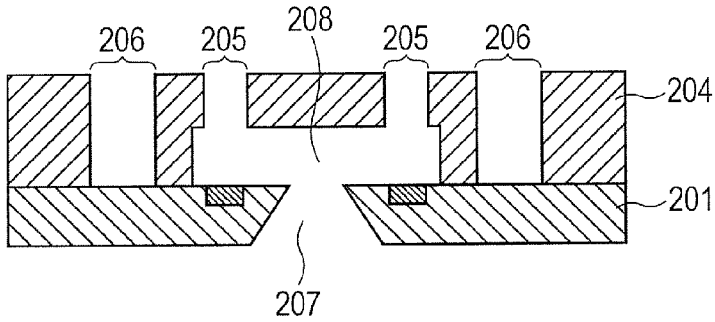
Figure 10:
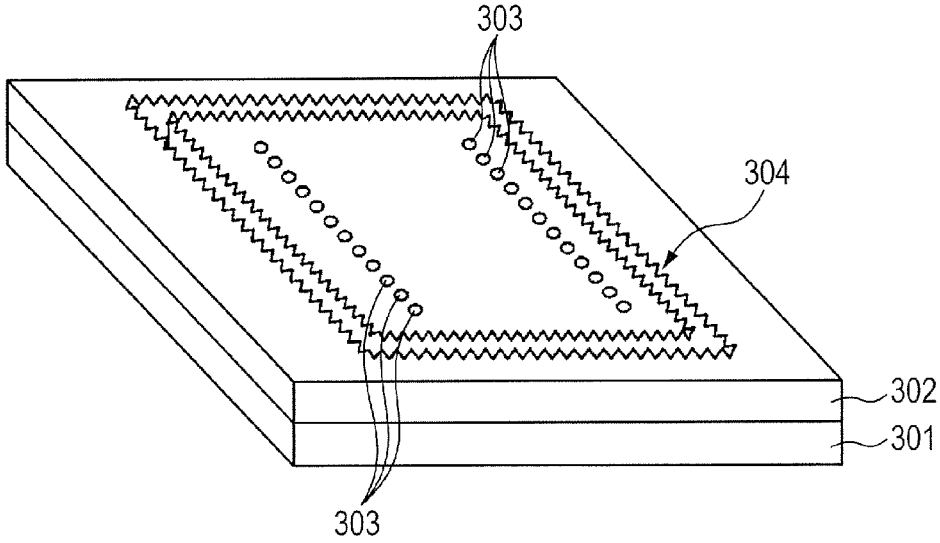
FIG. 10 is a schematic perspective view of a known liquid ejection head.

Now, a method of manufacturing a recording element substrate having the above-described configuration will briefly be described below. Firstly, pattern-forming resin layers like the resin layers 203*a* and 203*b* illustrated in FIG. 9A are formed on the surface of a substrate 11 on which a plurality of ejection energy generating elements 13 are arranged. Then, a resin layer that becomes an ejection port plate 21 is laid on the substrate 11 and the pattern-forming resin layers. Thereafter, ejection ports 22 and a groove 25 are formed by way of a photo-lithography process and an etching process. Finally, the pattern-forming resin layers are removed to produce a flow path 23 and a supply port 12 is formed by way of a semiconductor process such an anisotropic etching process. A recording element substrate manufactured in this way is then fitted to the main body part 10 of a recording apparatus 100 as illustrated in FIG. 4. More specifically, such a recording element substrate is fitted to the main body part 10 so as to make the nozzle surface 24 of the ejection port plate 21 to be exposed to the air.

FIG. 4 is a schematic perspective view of a recording apparatus according to the present invention, representing the configuration of a principal part thereof. The recording apparatus 100 as illustrated in FIG. 4 includes a liquid ejection head having the above-described configuration and a wiping member 2 for wiping the nozzle surface 24 of the liquid ejection head. The wiping member 2 wipes off the ink and the foreign objects adhering to the nozzle surface 24, while moving along the direction of arrangement of the ejection ports 22 (the longitudinal direction X of the supply port 12). In the liquid ejection head of this embodiment, a plurality of rows of ejection ports for inks of different colors are formed in parallel to each other. As the wiping member 2 is driven to move in a moving direction Y that is parallel to the direction of arrangement of the ejection ports 22 (the longitudinal direction X), inks are prevented from giving rise to color mixing.

Now, the results of relative evaluation of an embodiment of liquid ejection head according to the present invention in terms of peeling of the ejection port plate, adhesion of foreign objects and recording performance that were obtained in an evaluation session will be described below.

FIG. 5 is a table representing the results of relative evaluation of liquid ejection heads of different types including a liquid ejection head of the present invention in terms of peeling of the ejection port plate, adhesion of foreign objects and recording performance. Firstly, the ejection port plates that were evaluated will be described. In FIG. 5, "shape 1" refers to an ejection port plate of which the oppositely disposed lateral surfaces of the groove were corrugated so as to produce saw edged ridges and furrows and the ridges of the inner lateral surface are arranged exactly vis-a-vis the ridges of the outer lateral surface and "shape 2" refers to the ejection port plate 21 of the present invention, while "shape 3" refers to an ejection port plate of which the oppositely disposed lateral surfaces of the groove are made flat and each of the parts of the outer lateral surface that runs in parallel with the direction of arrangement of ejection ports is divided into four fractions and "shape 4" refers to an ejection port plate of which the oppositely disposed lateral surfaces of the groove were corrugated so as to produce saw edged ridges and furrows and the ridges of the inner lateral surface are displaced in the direction of arrangement of ejection ports relative to the ridges of the outer lateral surface. "Shape 5" refers to an ejection port plate in which two grooves having flat lateral surfaces are formed so as to run in parallel with each other.

Now, the evaluation items in FIG. 5 will be described below. The column of "foreign object" in FIG. 5 represents an evaluation item for which paper powder was sprinkled on each of the above-listed ejection port plates and each nozzle surface of the ejection port plates was wiped by the wiping member to see the removal ratio, or the ratio of the volume of the removed part of the foreign object relative to the entire volume of the foreign object. The column of "ink ball" represents an evaluation item for which the sizes of the ink balls produced in the groove of each of the ejection port plates were evaluated and the column of "recording" represents an evaluation item for which the printing performance of each of the ejection port plates was observed and evaluated under such a condition that ink balls were formed in the groove(s), while the column of "peeling" represents an evaluation item for which the extent to which each of the ejection port plates was peelable from the substrate was evaluated.

Now, the results of evaluation will be described below. The rating system in FIG. 5 is composed of "A" for good, "B" for fair and "C" for no good. As illustrated in FIG. 5, with regard to removal ratio, "shape 2" (the ejection port plate 21 of this embodiment) was rated highest and "shape 3" through "shape 5" showed substantially the same removal ratio, while "shape 1" showed the lowest removal ratio. With "shape 1", the width of the groove is reduced because the ridges of the inner lateral surface are arranged exactly vis-a-vis the ridges of the outer lateral surface. Then, as a result, "shape 1" represents a structure where foreign objects are apt to adhere to the wall surfaces of the groove. The lowest foreign object removal ratio of "shape 1" may be attributable to such a structure. With regard to "ink ball", no large ink ball was produced at "shape 2" and "shape 3". With regard to printing performance, each of "shape 2" through "shape 4" was rated as good. Other shapes gave rise to color mixing. With regard to "peeling", "shape 3" and "shape 5", in which the opposite lateral surfaces of the groove were made flat, seem to have a structure where the ejection port plate is peelable more easily than the other shapes.

From the above-described evaluation results, it is evident that the structure of the ejection port plate 21 of the present invention is most excellent in terms of peeling of the ejection port plate, adhesion of foreign object and recording. In the ejection port plate 21 of the present invention, the outer lateral surface 25*b* of the groove 25 is formed flat. Therefore, a foreign object can hardly adhere to it. Additionally, since the inner lateral surface 25*a* of the groove 25 is formed as a corrugated wall having saw edged ridges and furrows, the thermal stress that the ejection port plate 21 undergoes is alleviated. As a result, the ejection port plate 21 can hardly be peeled off from the substrate 11.

Figure 6A:
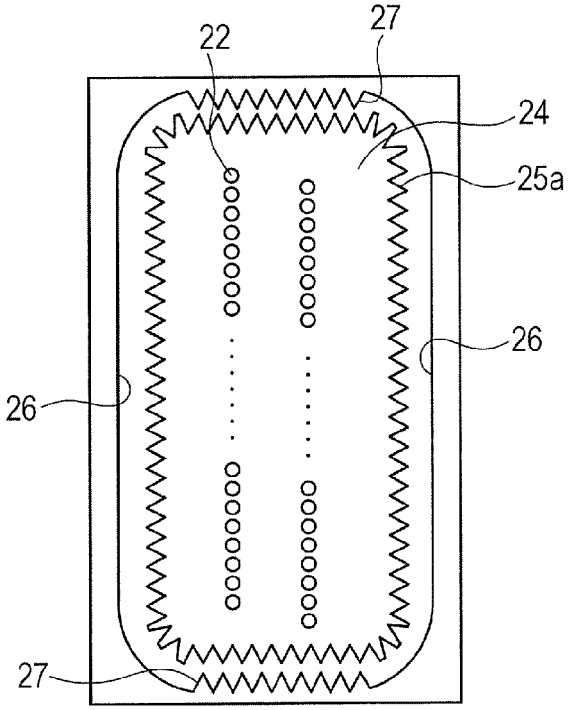
FIG. 6A is a schematic plan view of the ejection port plate of another embodiment of liquid ejection head according to the present invention.
Figure 11A:
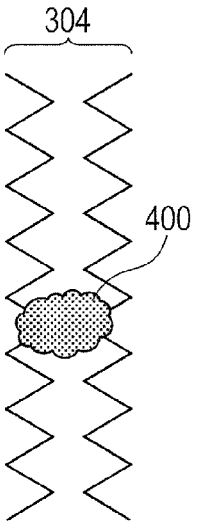
FIGS. 11A, 11B and 11C are schematic views, illustrating how a foreign object is caught in the groove formed in the known liquid ejection head illustrated in FIG. 10.
Figure 11B:
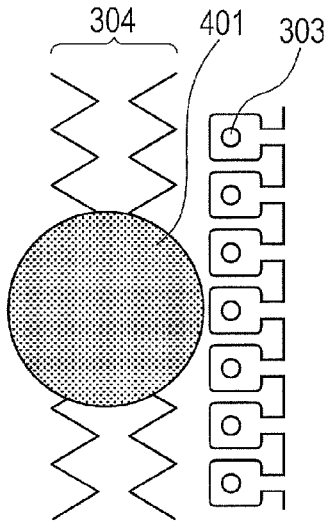
Figure 11C:
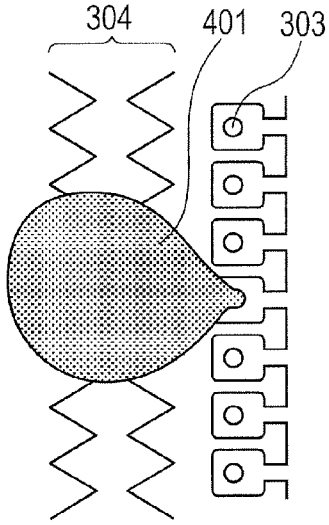

All the outer lateral surface 25*b* of the groove 25 is formed flat in this embodiment. However, the present invention is by no means limited to such a structure. Alternatively, for example, the parts 26 of the outer lateral wall 25*b* that run in parallel with the direction of arrangement of the ejection ports 24 may be made flat but the parts 27 of the outer lateral wall 25*b* that run in a direction orthogonal relative to the direction of arrangement of the ejection ports 24 may be corrugated so as to have saw edged ridges and furrows just like the inner lateral wall 25*a* as illustrated in FIG. 6A. With such a structure, the thermal stress that the peripheral portion of the ejection port plate 21 (the outer part of the ejection port plate 21 that surrounds the nozzle surface 24 with the groove 25 interposed between them) can be alleviated. In this structure, however, the foreign object adhering to any one of the parts 27 that are corrugated to produce saw edged ridges and furrows may not be removed with ease. Nonetheless, no ink ball 401 as illustrated in FIG. 11 will easily be formed in any one of the parts 27 if compared with the parts 26. Thus, faulty ejections may not occur with ease even if the parts 27 are corrugated to produce saw edged ridges and furrows.

Figure 6B:
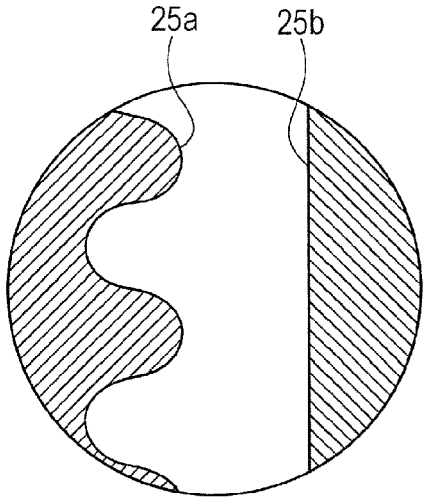
FIG. 6B is a schematic plan view of the ejection port plate of still another embodiment of liquid ejection head according to the present invention.
Figure 7:
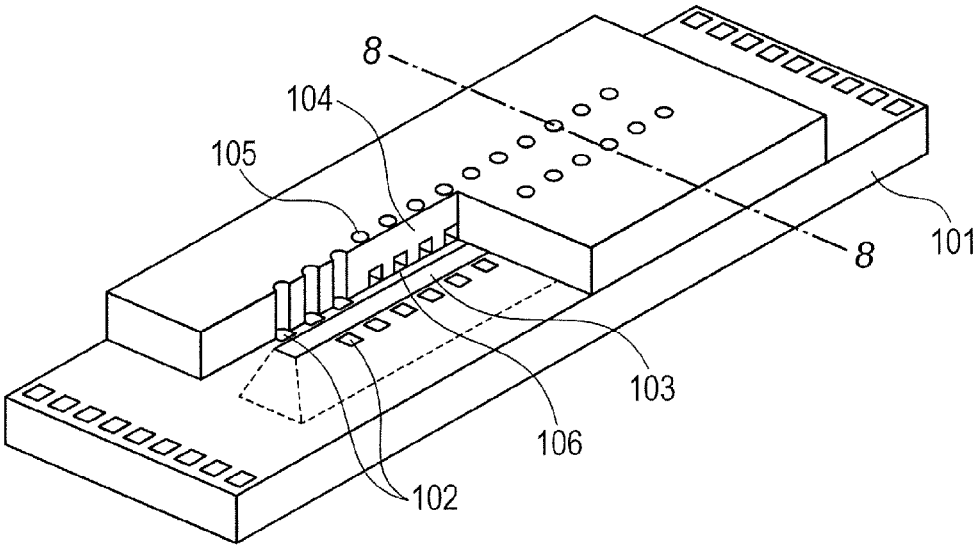
FIG. 7 is a schematic perspective view of a known liquid ejection head.
Figure 8:
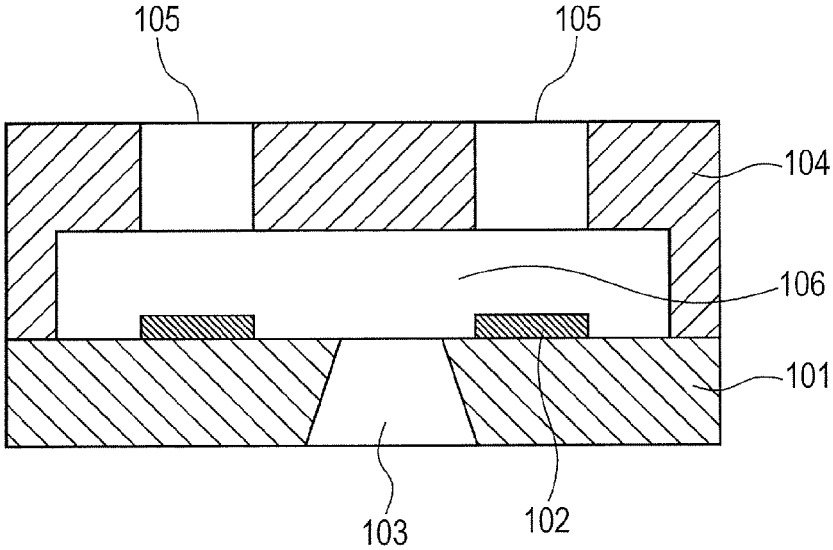
FIG. 8 is a schematic cross-sectional view of the known liquid ejection head taken along cutting line 8-8 in FIG. 7.

The ridges and the furrows on the inner lateral surface 25*a* of the groove 25 of this embodiment produce a shape drawn by a line that is bent at acute angles in cross section as illustrated in FIG. 3. However, the present invention is by no means limited to such a shape. Alternatively, for example, the inner lateral surface 25*a* of the groove 25 may be corrugated to produce round ridges and furrows as illustrated in FIG. 6B. Foreign objects can more hardly adhere to the groove 26 when the inner lateral surface 25*a* is made to represent such a profile.

In an experiment for evaluating the printing performance of the liquid ejection head of the present invention, the ejection port plate of this type was used to print and record characters. As a result of the experiment, the residual bubbles in the flow path were minimized and non-ejection and misdirection of ejected ink droplets that randomly and unexpectedly take place in known liquid ejection heads were eliminated so that the liquid ejection head performed excellently for printing and recording characters.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-103146, filed Apr. 27, 2012, which is hereby incorporated by reference herein in its entirety.

What is claimed is:

1. A liquid ejection head comprising:

a substrate that carries thereon a plurality of ejection energy generating elements arranged in rows to generate energy necessary for ejecting liquid; and an ejection port plate that is laid on the substrate and has a plurality of ejection ports formed therein and arranged in rows vis-a-vis the respective ejection energy generating elements, wherein the ejection port plate has a hole which runs through the ejection port plate and surrounds the rows of the ejection ports, the hole having an inner lateral surface on a center side with respect to the ejection port plate that is corrugated throughout its height to produce a plurality of projections and recesses arranged alternately and continuously so as to produce saw-edged ridges and furrows and an outer lateral surface on a periphery side with respect to the ejection port plate that is arranged oppositely relative to the inner lateral surface such that at least regions of the outer lateral surface running along the rows of the ejection ports are formed to be flat so as not to be corrugated.

2. The liquid ejection head according to claim 1, wherein the outer lateral surface is formed to be flat throughout its length.

3. The liquid ejection head according to claim 1, wherein parts of the outer lateral surface that run in a direction orthogonal relative to the direction of arrangement of the ejection ports is corrugated to produce saw-edged ridges and furrows.

4. The liquid ejection head according to claim 1, wherein the plurality of projections and recesses has a rounded profile.

5. A recording apparatus comprising:

a liquid ejection head according to claim 1; and a wiping member for wiping the nozzle surface of the liquid ejection head, while moving in the above direction of arrangement.

6. A liquid ejection head comprising:

a substrate that carries thereon a plurality of ejection energy generating elements to generate energy necessary for ejecting liquid; and an ejection port plate that has a plurality of ejection ports arranged in rows to eject liquid and a hole section formed along the rows of ejection ports, the ejection port plate being bonded to the substrate, wherein the hole section has an inner lateral surface located close to the rows of ejection ports and an outer lateral surface arranged vis-a-vis the inner lateral surface, and the inner lateral surface is formed to produce projections and recesses throughout its height, while the outer lateral surface is formed to be flat at regions running along the rows of the ejection ports.

7. The liquid ejection head according to claim 6, wherein the hole section is a through-hole that runs through the ejection port plate.

8. The liquid ejection head according to claim 6, wherein the hole section is formed between the rows of ejection ports and end faces of the ejection port plate.

9. The liquid ejection head according to claim 6, wherein the hole section is formed around the rows of ejection ports.

* * * * *